US006742563B2

(12) United States Patent
Belanger

(10) Patent No.: US 6,742,563 B2
(45) Date of Patent: Jun. 1, 2004

(54) KEYLESS ROLLING GRILLE

(75) Inventor: Michael B. Belanger, Cornwall (CA)

(73) Assignee: Dynamic Closures Corp., Cornwall (CA)

( * ) Notice: Subject to any disclaimer, the term of this patent is extended or adjusted under 35 U.S.C. 154(b) by 0 days.

(21) Appl. No.: 10/206,295

(22) Filed: Jul. 25, 2002

(65) Prior Publication Data

US 2004/0016516 A1 Jan. 29, 2004

(51) Int. Cl.[7] ..... E06B 9/08
(52) U.S. Cl. ..... 160/133; 160/229.1; 160/233
(58) Field of Search ..... 160/67, 68, 89, 160/133, 229.1, 231.1, 233–236

(56) References Cited

U.S. PATENT DOCUMENTS 3,237,239 A * 3/1966 Rudnick ..... 160/133 X
3,850,465 A 11/1974 Hill
3,857,433 A * 12/1974 Gatzi ..... 160/172
4,120,340 A * 10/1978 Stascavage et al. ..... 160/133
4,573,512 A 3/1986 Lichy
4,634,172 A * 1/1987 Duda ..... 296/163
5,343,922 A * 9/1994 Rankl et al. ..... 160/133
5,343,924 A * 9/1994 Hoffman ..... 160/235
5,372,175 A * 12/1994 Calhoun et al. ..... 160/235
5,474,117 A * 12/1995 Henkenjohann ..... 160/133
5,573,050 A * 11/1996 Henkenjohann ..... 160/133
5,850,862 A * 12/1998 Miller ..... 160/133

* cited by examiner

*Primary Examiner*—Bruce A. Lev

(57) ABSTRACT

A rolling grille having a set of horizontal bars, the bar set divided into a lower bar sub-set with a top bar and an upper bar sub-set with a bottom bar. The grille has a row of end plates on each side, the end plates joining the ends of the bars in both bar sub-sets together. Each end plate joins two adjacent bare together, each bar connected to two adjacent plates, the plates aligned when the grille closes an opening.

Each end plate has a panel with an inner surface facing inwardly when the grille closes the opening. Bar mounting sections are provided at the top and bottom of each panel. At least one of the top and bottom bar mounting sections in the plates in the lower bar sub-set have a flange comber located to abut on the inner surface of the panel of an adjacent plate when the grille closes an opening. The flange member flange forms the lower bar sub-set into a relatively rigid assembly when an attempt is made to raise the lower sub-set.

the grille has a locking linkage on each side joining the lower and upper sub-set of bars together, the locking linkage connected to the top bar in the lower sub-set and the bottom bar in the upper sub-set. The locking linkage has a lock link movable into a locking position when an attempt is made to raise the lower sub-set of bars.

16 Claims, 3 Drawing Sheets

KEYLESS ROLLING GRILLE

BACKGROUND OF THE INVENTION

1. Field of the Invention

This invention is directed toward a rolling grille. The invention is more particularly directed toward a rolling grille with a keyless locking system.

2. Description of the Related Art Including Information Disclosed UNDER CFR §§ 1.97–1.99

Rolling grilles of the type that are stored on a roller above an opening and unrolled down off the roller to close the opening are well known. The grille is unrolled off the roller and passes down between two stationary side members on the sides of the opening when closing the opening. Each side member has a slot facing the other side member and the sides of the grille are located within the members, the side portions of the grille passing through the-slots when the grille passes down. Locking means are provided to lock the grille when in the lowered, closed position. The locking means often employ key-operated locks. It is known however to use keyless locks that are hidden from view and which automatically lock the grille when an attempt is made to lift the grille up from the bottom to at least partially open the opening. The keyless lock is designed so that it does not lock when the grille is pulled from the top by operation of the roller to open the closure.

Examples of keyless locks on rolling grilles are shown in U.S. Pat. Nos. 3,850,465 and 4,573,512 by way of example. The known keyless locks however do not operate very satisfactorily. The links on the sides of the grille, joining the horizontal cross bars which form the main body of the grille, have too much play. Too much play is due in part to the slot, in each stationary side member of the grille assembly, being too wide. Too much play is also due in part to the links being able to over-rotate. With the links having too much play, the grille does not always remain rigid when lifted. Because the grille does not remain rigid, the locking link employed on the keyless lock, which forms part of the links, does not always catch to lock. Thus operation of the device is not consistent.

SUMMARY OF THE INVENTION

It is the purpose of the present invention to provide a rolling grille with a hidden keyless lock that is constructed to operate consistently.

In accordance with the present invention there is provided a rolling grille having cross bars joined by end plates, each pair of adjacent cross bars joined at the ends by an end plate. The end plates are constructed to have the grille remain relatively rigid when lifted from the bottom thus ensuring that the locking link operates properly. Each end plate is provided with abutment means that abuts against an adjacent plate to prevent relative rotation of the plates in one direction. With the plates unable to rotate in one direction relative to each other the grille stays relatively rigid when lifted.

The invention is particularly directed toward a rolling grille having a set of horizontal cross bars, the cross bar set divided into a lower bar sub-set with a top bar and an upper bar sub-set with a bottom bar. The grille has a row of end plates on each side of the grille joining the ends of the bars in at least the lower bar sub-set together, each plate in the lower bar sub-set joining two adjacent bars together, each bar connected to two adjacent plates, the plates aligned when the grille closes an opening. Each plate has a panel and at least one bar mounting section at the top and bottom of each panel, at least one of the top and bottom bar mounting sections having stop means located to abut on the outer surface of the panel of an adjacent plate when the grille closes an opening. The grille has a locking linkage on each side joining the lower and upper sub-set of bars together, the locking linkage connected to the top bar in the lower sub-set and the bottom bar in the upper sub-set and aligned with the end plates. The locking linkage has a lock link movable into a locking position when an attempt is made to raise the lower sub-set of bars.

DESCRIPTION OF THE PREFERRED EMBODIMENTS

Figure 1:
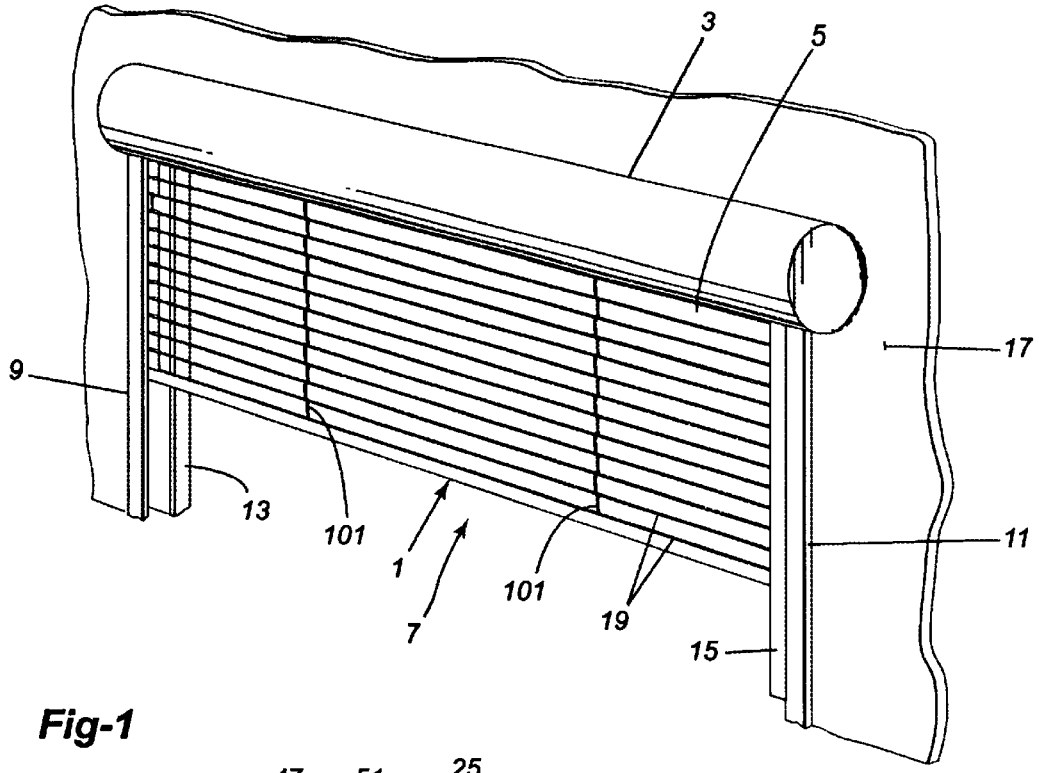
FIG. 1 is a schematic rear view of the grille in a partially closed position.

The rolling grille 1 of the present invention, as shown in FIG. 1, is mounted on a roller (not shown) in a casing 3 that is mounted over the top 5 of an opening 7. The grille 1 is wound on the roller within the casing 3 when the closure is open, and extends down between two side guide members 9, 11 on the sides 13, 15 of the opening 7 to close the opening. A motor (not shown) is selectively operated to rotate the roller in either direction to raise or lower the grille as is well known. The casing 3 and side guide members 9, 11 are normally mounted on the inside of the wall 17 defining the opening 7 so as to be within a building or room containing the wall.

The grille 1 will be described in detail in the closed position with the term 'top' used in a direction toward the top of the opening to be closed by the grille (or top of the page when looking at FIG. 1); the term 'bottom' used in a direction toward the bottom of the opening (or the bottom of the page); the terms 'inner' and 'inwardly' used in a direction toward the inside of the space being closed (or out of the page); the terms 'outer' and 'outwardly' being used in a direction toward the outside of the space being closed (or into the page), the term 'inside' being used in a direction toward the middle of the grille and the term 'outside' being used in a direction toward the sides of the grille.

Figure 2:
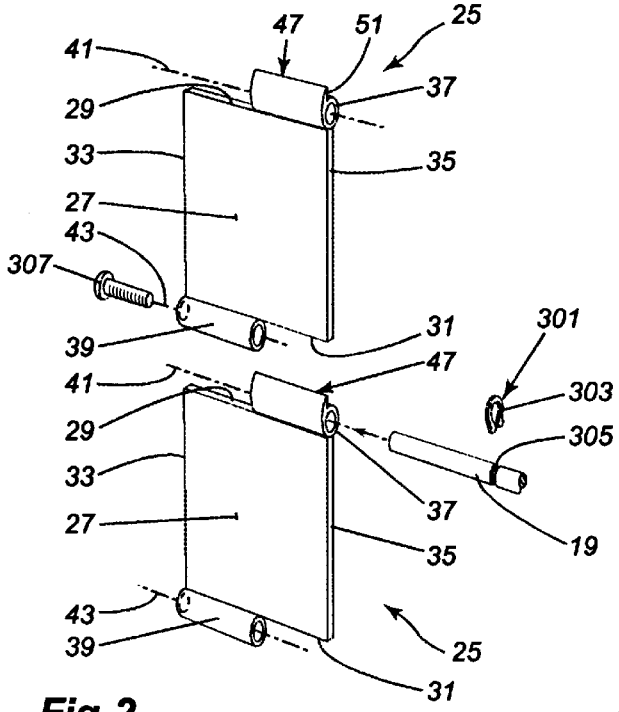
FIG. 2 is a perspective, exploded, view showing two end plates assembled to a bar.
Figure 3:
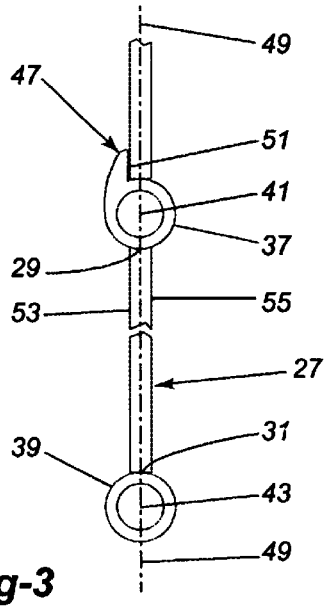
FIG. 3 is a partial side view of the end plates of FIG. 2 assembled.

The grille 1, as shown in FIGS. 2 to 5, has a set of horizontal, spaced-apart, cross bars 19 extending between the guide members 9, 11. The bars 19 are divided into two sub-sets 21, 23 connected by a link mechanism on each side of the grille as will be described. A series of end plates 25, on each side of the grille join the bars 19, in each sub-set 21, 23, together. Each end plate 25, as shown in FIGS. 2 and 3, has a main panel 27 that is quadratic in shape. The panel 27 is usually rectangular in shape with relatively short top and bottom edges 29, 31 and relatively long side edges 33, 35. A bar mounting section 37, 39 is mounted on the top and bottom edges 29, 31 respectively of the panel 27. The top bar mounting section 37 is adjacent one side edge 35 of the panel and the bottom bar mounting section 39 is adjacent the other side edge 33 of the panel. Each bar mounting section 37, 39 is preferably a tubular member with the longitudinal axii 41, 43 of the members 37, 39 parallel with the top and bottom edges 29, 31 of the panel 27. The mounting sections 37, 39 are each no longer than half the width of the panel 27.

The top bar mounting section 37 on each end plate 25 has a stop member 47 projecting therefrom in a direction opposite to the direction in which the panel 27 extends from the top section 37. The stop member 47 is in the form of a flange parallel to the longitudinal axis 41 of the top mounting section 37 and is on one side of a plane 49 joining the longitudinal axii 41, 43 of the top and bottom mounting sections 37, 39. The stop member 47 has an abutment surface 51 aligned with the outer side surface 53 of the panel 27 which side surface 53 is on the same side of the plane 49 as the stop member 47, the other inner side surface 55 of the panel 27 being on the other side of the plane 49. Each plate 25, when forming part of the grille, is mounted on the bars 19 to have the abutment surface 51 of the flange facing in an inner direction.

Figure 4:
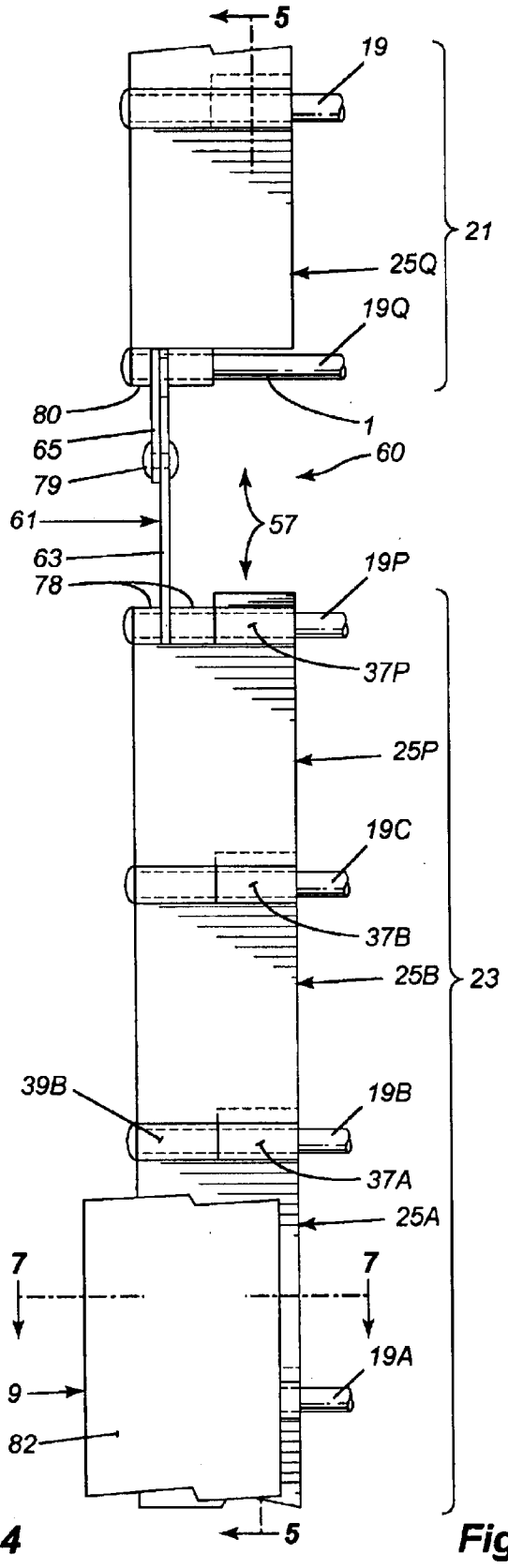
FIG. 4 is a partial front view of the assembled grille with the side guide means partially cut away.

The end plates 25 are arranged serially in a row 57, as shown in FIG. 4, one row on each side of the grille, to join the bars 19 together. In each row a first plate 25A joins bars 19A, 19B with bottom section 39A (not shown) receiving bar 19A and top section 37A receiving top bar 19B. Top section 37A is on the inside of the row of plates. A second plate 25B joins bars 19B and 19C. The bottom section 39B of the second plate 25B lies adjacent the top section 37A on the first plate. The top section 37B of the second plate is on bar 19C on the inside of the row of plates. The pattern of plates described above is repeated for the entire row of plates in each sub-set. All the plates used, on each side of the grille, are identical. It will be seen that each plate joins two adjacent bars and that each bar is held by two adjacent plates. The bottom section 39 of each plate 25 shares space with the top section 37 of each adjacent bottom plate on the cross bar 19 common to both plates. The panels 27 of all the plates 25 are aligned vertically in each row. More importantly, the stop members 47 on all the plates 25 on each side of the grille face in an inner direction, contacting the outer surface 53 of the panel 27 on the plate 25 above. This prevents the plates 25 from rotating outwardly relative to each other, keeping the grille more rigid, while still allowing the grille to wind/unwind easily on and off the reel.

Figure 6:
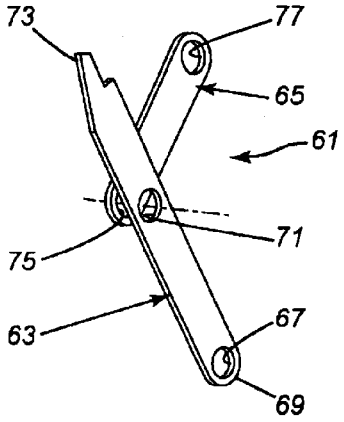
FIG. 6 is a perspective view of the links in the link mechanism.

The grille 1 includes a keyless locking mechanism 60 on at least one and preferably both sides of the grille. The keyless locking mechanism 60 has a link mechanism 61 joining the two sub-sets 21, 23 of grille bars 19. The link mechanism 61 has a lock link 63 and a connector link 65 as shown in FIG. 6. The lock link 63 has a length generally the same as the length of the one of the plates 25 and has a first pivot hole 67 at one end 69 and a second pivot hole 71 intermediate its ends 69, 71. Its other end 73 is blunt forming an abutment. The connector link 65 is about half the length of the lock link 63 and has pivot holes 75, 77 at its ends.

One end 69 of the lock link 63 is mounted via pivot hole 67 on the upper bar 19P of the lower sub-set 21 of bars 19. Spacer members 78 can be provided on the bar 19P to locate the link 65 on the bar relative to the top section 37P on the top plate 25P in the lower sub-set 21. One end of the connector link 65 is mounted adjacent the lock link 63 by a pivot member 79 passing through the pivot holes 71, 75 on the links 63, 65 respectively. The pivot member 79 can be a rivet, a screw, or a similar fastener means allowing the links to freely pivot relative to each other. The connector link 65 is mounted via its other pivot hole 77 to the bottom bar 19Q of the upper sub-set 23 of bars. Part of the bottom bar mounting section 39Q of the plate 25Q is cutaway to receive the link 65 on the bar 19Q. A spacer 80 can be used on the bar 19Q to locate the connector link 65 on the bar if required.

Figure 5:
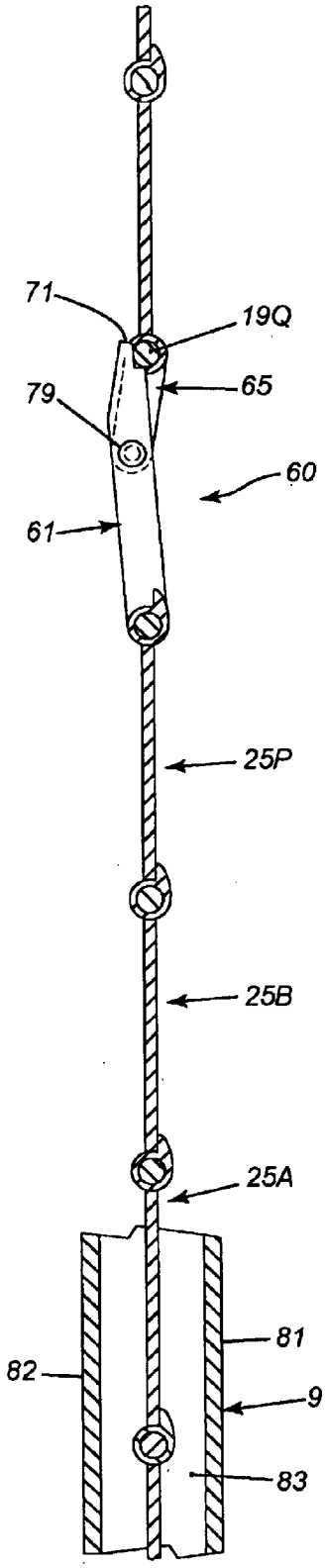
FIG. 5 is a cross-section view taken along line 5–5 in FIG. 4.

When the link mechanism 61 is in place, and the grille is lowered to close the opening, the lower sub-set 21 of bars hangs down therefrom, and the abutment end 73 of lock link 63 abuts on the bottom bar 19Q of the upper set 23 of bars, the connector link 65 extending slightly in an inner direction from bar 19Q as shown in FIG. 5. The lock link 63 in this position is in an unlocked position. In this unlocked position, it will be seen that the pivot member 79 is offset just inwardly of a line joining the centers of bottom and top bars 19P, 19Q of the bottom and top bar sub-sets 23, 21.

Figure 7:
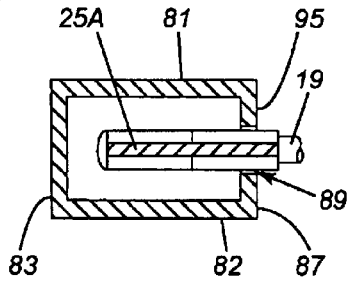
FIG. 7 is a cross-section view taken along line 7–7 in FIG. 4.

The side guide members 9, 11, as shown in FIG. 7, are each channel shaped with the opening or slot into the interior space of the channel on one member facing the opening or slot on the other member. Each member has a pair of side walls 81, 82, joined at one end by a back wall 83. The front wall is in two parts 85, 87, one part on each side wall, the parts 85, 87 defining a slot 89 between them. The slot 89 is just wide enough to snugly receive the end plates 25 and bars 19, the bars and plates passing freely through the slot.

The locking mechanism 60 includes a stop on each side member 9, 11. The stop 91 is formed by the top edge of an opening 95 formed in the inner side wall 81 of the side members. The opening 95 is preferably located up high on the inner side of the guide, above the top of the wall opening 7 and it is covered by a closure plate 99 securely fastened to the inner side wall 81 of the guide.

The grille 1 is assembled from the cross bars and end plates, the locking linkage, and intermediate links, if used, and mounted at one end on the roller. The grille extends between the side guide members 9, 11 with the plates 25 and the ends of the cross bars 19 passing through the slots 89 into the side members. When the grille is fully closed, the link mechanism 61 is opposite the opening 95 in the side members.

Figure 8:
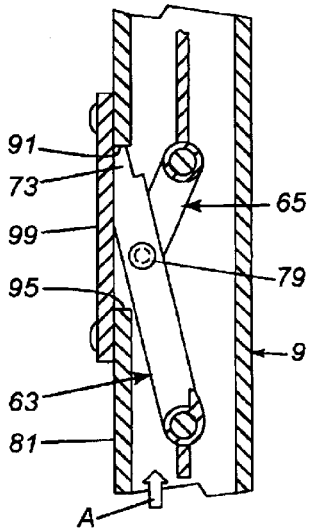
FIG. 8 is a view similar to FIG. 5 but with the bottom sub-section raised to show the link mechanism locking.

If the grille is raised by the motor rotating the roller, the locking link 63 stays in the unlocked position abutting against bar 19Q as shown in FIG. 5, and pulls the lower sub-set 23 of bars upwardly as it is raised by the upper sub-set 21 of bars via the roller. However, if an attempt is made to raise the lower sub-set 23 of bars manually, as shown by the arrow 'A' in FIG. 8, to gain access under the grille, the plates 25 in the lower sub-set 23 remain aligned and relatively rigid due to the stop members 47 and cause the locking link 63 to move to a locked position, the lock link 63 pivoting inwardly as shown in FIG. 8 to abut the closure plate 99. The locking link 63 will pivot inwardly due to the slight initial inward offset of the pivot member 79. Continued raising of the lower sub-set 23 causes the abutment end 73 on the link 63 to abut on the stop 91 provided by opening 95 formed in the wall 81 of the side guide member. This limits raising of the lower sub-set 21 of bars. Releasing the lower sub-set 21 of bars pulls the locking link 63 back into an unlocked position.

The locking mechanism 60 described is old and is substantially the same as the locking mechanism shown in U.S. Pat. No. 3,850,465. The slot 89 in the side guides 9, 11 is preferably made quite narrow so that the bars 19 and plates 25 fit snugly therein but are free to easily slide up and down. This helps to make the lower sub-set 23 of bars more rigid when the lower sub-set is pushed up thereby making it easier for the link mechanism 61 to automatically operate.

The grille may have one or more rows of intermediate links 101, spaced from the sides of the grille, between the bars 19 to join them if the grille is quite wide, as shown in FIG. 1. The specific links in the rows of intermediate links which join the lower and upper sub-sets 21, 23 of bars together, have elongated pivot holes (not shown) allowing the lower bar sub-set 23 to move up relative to the upper bar sub-set 21 during operation of the link mechanism 61 on the sides.

The grille has been described as having the same end plates in both sub-sets of bars. However, the plates used in the upper sub-set of bars can be made without the stop means. The stop means is essential only in the bottom sub-set of bars to ensure proper operation of the link mechanism 61 each time the bottom sub-set of bars is attempted to be raised from the bottom.

Figure 9:
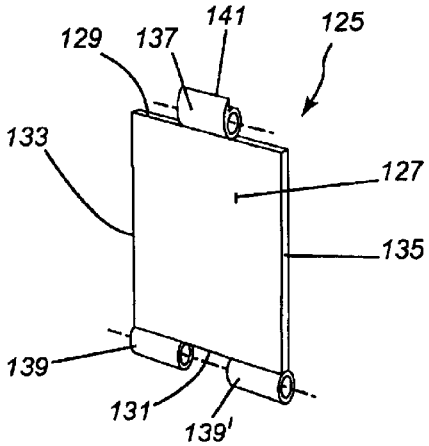
FIG. 9 is a perspective view of another embodiment of an end plate.

While the plates 25 have been described as being provided with one top bar mounting section 37 on the top edge of the panel and on one side of the panel of the plate, and with a bottom bar mounting section 39 on the bottom edge, on the opposite side, of the panel, other arrangements of bar mounting sections can be employed on the panel. For example, as shown in FIG. 9, each plate 125 can still have a main panel 127 that is quadratic in shape, the panel 127 usually rectangular in shape with short top and bottom edges 129, 131 and long side edges 133, 135. However in this embodiment, a single top bar mounting section 137 is mounted on the top edge 129 in the center of the panel and two bottom bar mounting sections 139, 139' are mounted on the bottom edge 131 of the panel adjacent the side edges 133, 135. The two bottom mounting sections 139, 139' are spaced apart a distance equal to the width of the top mounting section 137. The top mounting section 137 of each plate fits in between the two spaced apart bottom sections 139, 139' on the next adjacent panel. Each plate in this embodiment still carries a stop member similar to the stop member 47 shown in plate 25 in the form of a flange 141 on the top of the top bar mounting section, the flange located to abut the outer surface on the panel of the plate above. While the plate has been shown with the single bar mounting section at the top it could be at the bottom instead with the double bar mounting sections at the top. One of these plates 125, when used in the position of plate 25P is modified by cutting a piece off the central, top, mounting section 137P to accommodate the link mechanism 61.

Figure 10:
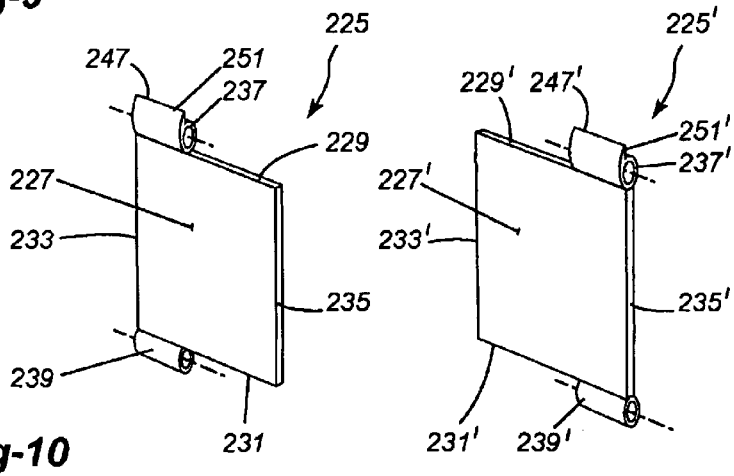
FIG. 10 is a perspective view of yet another embodiment of an end plate.

In another embodiment shown in FIG. 10, two different sets of plates 225, 225' can be used. Each plate 225, 225' can again have a main panel 227, 227' that is quadratic in shape, the panels 227, 227' usually rectangular in shape with narrow top and bottom edges 229, 231 and 229', 231' respectively and wide side edges 233, 235 and 233', 235' respectively. However in this embodiment, plate 225 has single top and bottom bar mounting sections 237, 239, mounted on the top and bottom edges 229, 231 respectively, adjacent one side 233 of the panel. Plate 225' has single top and bottom bar mounting sections 237', 239' mounted on the top and bottom edges 229, 231' respectively on the other side 235' of the panel. Both plates have the abutment 247, 247' on the top bar mounting section with the abutment surface 251, 251' facing inwardly when the plate is on the grille. The plates are used in an alternating arrangement to form the plate row on each side of the grille with the bottom section on each plate abutting the top section on the adjacent bottom plate irregardless of whether the top section is on the inside or outside of the plate. These plates need no modification to accommodate the link mechanism 61, only spacer members to locate the link mechanism on the bars.

In all embodiments, a stop member 301, as shown in FIG. 2, can be used with each plate to prevent movement of the plate inwardly on the bars. The stop member 301 can comprise a C-clip 303 snapped onto a groove 305 in the bar 19 against which the plate 25 on the bar is abutted. A screw or bolt 307 is threaded into each bar at its end to hold the plates on the other side of the bar.

While all the embodiments of the plates show the stop means on a plate on a top bar mounting section, it can also be provided on a bottom bar mounting section instead.

I claim:

1. A rolling grille having:

a set of horizontal bars, the bar set divided into a lower bar sub-set with a top bar and an upper bar sub-set with a bottom bar;

a row of end plates on each side of the grille joining the ends of the bars in at least the lower bar sub-set together, each plate in the lower bar sub-set joining two adjacent bars together, each bar connected to two adjacent plates, the plates aligned when the grille closes an opening;

each plate having a panel with an outer surface facing outwardly when the grille closes the opening and bar mounting sections at the top and bottom of each panel, at least one of the top and bottom bar mounting sections having stop means located to abut on the outer surface of the panel of an adjacent plate when the grille closes an opening, the stop means forming the lower bar sub-set into a relatively rigid assembly when an attempt is made to raise the lower sub-set;

and a locking linkage on each side joining the lower and upper sub-set of bars together, the locking linkage connected to the top bar in the lower sub-set and the bottom bar in the upper sub-set and aligned with the end plates, the locking linkage having a locks link movable into a locking position when an attempt is made to raise the lower sub-set of bare when the grille closes an opening.

2. A rolling grille as claimed in claim 1 including a row of end plates on each side of the grille joining the ends of the bars in the upper bar sub-set together, each plate in the upper bar sub-set joining two adjacent bars together, each bar connected to two adjacent plates, the plates aligned when the grille closes an opening.

3. A rolling grille as claimed in claim 2 including side guide members, one on each side of the grille, each guide member having a central hollow space defined by parallel side walls joined at one end by an end wall, the other end wall having a slot therein throughout its length providing access to the central space, the guide member snugly receiving and guiding the end plates, the locking linkage and the ends of the bare within the central space through the slot.

4. A rolling grille as claimed in claim 3 including abutment means on the side guide member aligned with the locking linkage when the grille closes an opening, the lock link on the locking linkage cooperating with the Abutment means when an attempt is made to raise the lower sub-set of bars to prevent raising or the lower sub-set.

5. A rolling grille as claimed in claim 4 wherein the abutment means comprise an opening formed in the inner wall of the guide member, the opening adjacent the locking linkage with the upper edge of the opening slightly above the lock link and receiving the lock link to prevent upward movement when an attempt is made to raise the lower sub-set.

6. A rolling grille as claimed in claim 5 wherein the stop means comprise a flange member extending outwardly from bar mounting section in a direction opposed to the direction the panel extends from the section.

7. A rolling grille as claimed in claim 6 wherein the flange member has a stop surface aligned with the outer surface of the panel.

8. A rolling grille as claimed in claim 4 wherein the plates are identical and the bar mounting sections on each plate comprise a single section centrally located on one of the top or bottom edges of the panel, and two sections on the other of the top and bottom edges located adjacent the sides of the panel, the two sections spaced apart a distance at least equal to the length of the single section.

9. A rolling grille as claimed in claim 4 wherein the plates are identical and the bar mounting sections on each plate comprise a single section mounted on one side of one of the top or bottom edges of the panel, and a single section mounted on the other side of the other of the top or bottom edges of the panel.

10. A rolling grille as claimed in claim 4 wherein the plate comprise two sets of plates with a first set of plates having one section on both the top and bottom edges of the panel on one side of the plate, and the second set of plates have one section on both the top and bottom edges of the panel on the other side of the plate.

11. A rolling grille as claimed in claim 1 wherein the plates are identical and the bar mounting sections on each plate comprise a single section centrally located on one of the top or bottom edges of the panel, and two sections on the other of the top and bottom edges located adjacent the sides of the panel, the two sections spaced apart a distance at least equal to the length of the single section.

12. A rolling grille as claimed in claim 1 wherein the plates are identical and the bar mounting sections on each plate comprise a single section mounted on one side of one of the top or bottom edges of the panel, and a single section mounted on the other side of the other of the top or bottom edges of the panel.

13. A rolling grille as claimed in claim 1 wherein the plates comprise two sets of plates with one set of plates having one section on both the top and bottom edges of the panel on one side at the plate, and the other set of plates have one section on both the top and bottom edges of the panel on the other side of the plate.

14. A rolling grille as claimed in claim 1 wherein the stop means comprise a flange member extending outwardly from bar mounting section in a direction opposed to the direction the panel extends from the section.

15. A rolling grille as claimed in claim 14 wherein the flange member has a stop surface aligned with the outer surface of the panel.

16. A rolling grille having;

a set of horizontal bars, the bar set divided into a lower bar sub-set with a top bar and an upper bar sub-set with a bottom bar, a row of end plates on each side of the grille joining the ends of the bars in at least the lower sub-set together, each row having alternating first and second plates, each plate joining two adjacent bars together, each bar connected by two adjacent plates, the plates aligned when the grille closes an opening;

each first plate having a panel with an outer surface facing outwardly when the grille closes the opening, a bar mounting section at the top and at the bottom of the panel, the bar mounting sections on one side of the panel, stop means on at least one of the bar mounting sections located to abut on the outer surface of the panel of an adjacent second plate, each second plate having a panel with an outer surface facing outwardly when the grille closes the opening, bar mounting sections at the top and bottom of the panel, the bar mounting sections on the other side of the panel, stop means on the same bar mounting section as in the first plate located to abut an the outer surface of the panel of an adjacent plate, and a locking linkage joining the lower and upper sub-set of bars together, the locking linkage connected to the top bar in the lower sub-set and the bottom bar in the upper sub-set and aligned with the end plate, the locking linkage have a lock link movable into a locking position when an attempt is made to raise the lower sub-set of bars.

* * * * *